US008238791B2

(12) United States Patent
Kim et al.

(10) Patent No.: US 8,238,791 B2
(45) Date of Patent: Aug. 7, 2012

(54) FUSING UNIT INCLUDING PIVOTING FRAME AND IMAGE FORMING APPARATUS HAVING THE SAME

(75) Inventors: Jong Min Kim, Seoul (KR); Tae Won Eom, Gyeonggi-do (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 302 days.

(21) Appl. No.: 12/645,728

(22) Filed: Dec. 23, 2009

(65) Prior Publication Data

US 2010/0158588 A1 Jun. 24, 2010

(30) Foreign Application Priority Data

Dec. 24, 2008 (KR) ..... 10-2008-132992

(51) Int. Cl.
*G03G 15/20* (2006.01)

(52) U.S. Cl. ..... 399/122

(58) Field of Classification Search ..... 399/122, 399/328

See application file for complete search history.

(56) References Cited

U.S. PATENT DOCUMENTS

2006/0257179 A1* 11/2006 Kim et al. ..... 399/322
2007/0110487 A1* 5/2007 Kim et al. ..... 399/328
2009/0297180 A1* 12/2009 Kajita ..... 399/33

FOREIGN PATENT DOCUMENTS

JP 2005-003940 1/2005
JP 2008-019080 1/2008

* cited by examiner

*Primary Examiner* — Quana M Grainger
(74) *Attorney, Agent, or Firm* — Stanzione & Kim, LLP

(57) ABSTRACT

A fusing unit and an image forming apparatus having the same. The fusing unit may include a heating roller, a fusing frame to which the heating roller may be mounted, a pivoting frame to mount to the fusing frame to be rotatable about the heating roller, and a plurality of pressure rollers to mount to the pivoting frame and to be elastically supported on an outer peripheral surface of the heating roller. When paper that undergoes serious curling beyond an appropriate level is used, the pressure rollers may rotate to allow paper having passed between the heating roller and the pressure rollers to move in a path rotated by an angle corresponding to a rotation angle of the pressure rollers. This exemplary embodiment may reduce paper jam.

16 Claims, 5 Drawing Sheets

FUSING UNIT INCLUDING PIVOTING FRAME AND IMAGE FORMING APPARATUS HAVING THE SAME

CROSS-REFERENCE TO RELATED APPLICATIONS

This application claims priority under 35 U.S.C. §119(a) of Korean Patent Application No. 10-2008-0132992, filed on Dec. 24, 2008 in the Korean Intellectual Property Office, the disclosure of which is incorporated herein by reference.

BACKGROUND

1. Field of the Invention

Exemplary embodiments of the present general inventive concept relate to a fusing unit to fuse developer to paper and an image forming apparatus having the same.

2. Description of the Related Art

Generally, image forming apparatuses are devised to form an image on a printing medium, such as, e.g. paper, based on input image signals. Examples of image forming apparatuses may include printers, copiers, facsimiles, and so-called multi-functional devices that combine some of the functionalities of the aforementioned devices.

Such an image forming apparatus may include a printing media storage unit in which plural sheets of paper are received, a developing unit to feed developer to an electrostatic latent image so as to develop the electrostatic latent image into a visible image, an exposure unit to form the electrostatic latent image on a photoconductor of the developing unit, a fusing unit to fuse developer transferred to paper, and a paper discharge unit to discharge paper, on which the image is completely formed, to the outside of the body.

Given the above-described configuration, after light is irradiated to the charged photoconductor of the developing unit to form an electrostatic latent image on a surface of the photoconductor, developer may be fed to the electrostatic latent image formed on the photoconductor, to develop the electrostatic latent image into a visible image. Subsequently, the visible image formed on the photoconductor may be transferred to paper supplied from the printing media storage unit. As the paper passes through the fusing unit, the visible image transferred to the paper may be fused to the paper, completing formation of the image on the paper. The paper, on which the image is completely formed, may be discharged out of the body via the paper discharge unit.

Of the above-mentioned constituent elements of the image forming apparatus, the fusing unit may include a heating roller, and a pressure roller elastically supported on an outer peripheral surface of the heating roller, and a pair of paper discharge rollers to discharge paper, to which an image may completely be fused, out of the fusing unit. Thus, after developer is transferred and fused to paper passing between the heating roller and the pressure roller by heat and pressure transmitted from the heating roller and pressure roller, the paper may be discharged from the fusing unit via the pair of paper discharge rollers.

In the above-described image forming apparatus, when the paper passes between the heating roller and the pressure roller, the paper inevitably undergoes curling due to the heat and pressure transmitted thereto. Therefore, positions of the two paper discharge rollers of the fusing unit may be determined in consideration of paper curling. Since a curling degree will be changed according to various factors, such as the texture or moisture content of paper, etc., some paper may undergo serious curling beyond an appropriate level while passing between the heating roller and the pressure roller. This may make it impossible for the paper to enter between the paper discharge rollers of the fusing unit, thus causing paper jam.

SUMMARY

It is an aspect of the present general inventive concept to provide a fusing unit to reduce paper jam even if paper undergoes serious curling beyond an appropriate level, and an image forming apparatus having the same.

Additional features and utilities of the present general inventive concept will be set forth in part in the description which follows and, in part, will be obvious from the description, or may be learned by practice of the general inventive concept.

In accordance with an exemplary embodiment of the present general inventive concept, a fusing unit may include a heating roller, a fusing frame to which the heating roller may be mounted, a pivoting frame to mount to the fusing frame so as to be rotatable about the heating roller, and a plurality of pressure rollers to mount to the pivoting frame and to be elastically supported on an outer peripheral surface of the heating roller.

The fusing unit may further include a pivoting lever to mount to the fusing frame and to rotate the pivoting frame upon receiving an external force.

The fusing unit may further include a return spring having one end supported by the fusing frame and the other end supported by the pivoting frame, the return spring to return the pivoting frame to an original position thereof.

The fusing frame may be provided with a first holder to be caught by the pivoting lever so as to keep the pivoting frame in a rotated state, and the pivoting lever may be provided with a second holder to be caught by the first holder.

The fusing unit may further include a roller bracket to which each of the pressure rollers is rotatably mounted, the roller bracket to mount to the pivoting frame so as to be movable forwardly or rearwardly to or from the heating roller, and a press spring having one end supported by the pivoting frame and the other end supported by the roller bracket.

The pivoting frame may have a guide recess formed in a radial direction of the heating roller, the roller bracket being provided in the guide recess in a forwardly and rearwardly movable manner.

The fusing unit may further include a pressure-release lever to rotatably mount to the pivoting frame and adapt to move the plurality of pressure rollers outward in a radial direction of the heating roller via rotation thereof so as to release pressure usable with the heating roller.

The pressure-release lever may be formed with a holding protrusion to be caught by the roller bracket, and the roller bracket may be provided with a holding recess to insert the holding protrusion.

The fusing unit may further include a pair of paper discharge rollers to guide paper having passed between the heating roller and the plurality of pressure rollers so as to discharge the paper to the outside of the fusing unit.

In accordance with an exemplary embodiment of the present general inventive concept, a fusing unit may include a heating roller, and a plurality of pressure rollers elastically supported on an outer peripheral surface of the heating roller and movably provided in a circumferential direction of the heating roller about the heating roller.

The fusing unit may further include a pivoting frame to be rotatably provided about the heating roller, the plurality of pressure rollers to mount to the pivoting frame, a pivoting lever to rotate the pivoting frame upon receiving an external force, and a return spring to elastically support the pivoting frame so as to return the pivoting frame to an original position thereof.

The fusing unit may further include a roller bracket to which each of the pressure rollers may rotatably mount, the roller bracket to mount to the pivoting frame so as to be movable forwardly or rearwardly to or from the heating roller, a press spring having one end supported by the pivoting frame and the other end supported by the roller bracket, and a pressure-release lever to move the roller bracket outward in a radial direction of the heating roller upon receiving the external force, so as to release pressure usable with the heating roller.

In accordance with a further feature and utility of the present general inventive concept, an image forming apparatus may include a fusing unit to fix developer to paper, and the fusing unit may include a heating roller, a fusing frame to which the heating roller is mounted, a pivoting frame may be mounted to the fusing frame so as to be rotatable about the heating roller, and a plurality of pressure rollers to mount to the pivoting frame and to be elastically supported on an outer peripheral surface of the heating roller.

Embodiments of the present general inventive concept further include a fusing unit, including a heating roller, and a plurality of pressure rollers to movable in a circumferential direction of heating roller while elastically mounted about the heating roller.

Embodiments of the present general inventive concept further include a method of guiding curled printing media within a fusing unit, including placing printing media on a path between a heating roller and a plurality of pressure rollers, identifying curling of the printing media via misalignment of the printing media exiting the path, and adjusting a pivoting lever to rotate the plurality of pressure rollers about the heating roller, wherein rotation of the plurality of pressure rollers changes the direction of the printing media exiting the path.

Embodiments of the present general inventive concept further include an image formation device, including a heating roller, and a plurality of pressure rollers to elastically rotate about the perimeter of the heating roller while being capable of gyration about the heating roller.

BRIEF DESCRIPTION OF THE DRAWINGS

Exemplary embodiments of the present general inventive concept will become apparent and more readily appreciated from the following description of the exemplary embodiments, taken in conjunction with the accompanying drawings of which.

DETAILED DESCRIPTION OF THE EXEMPLARY EMBODIMENTS

Figure 1:
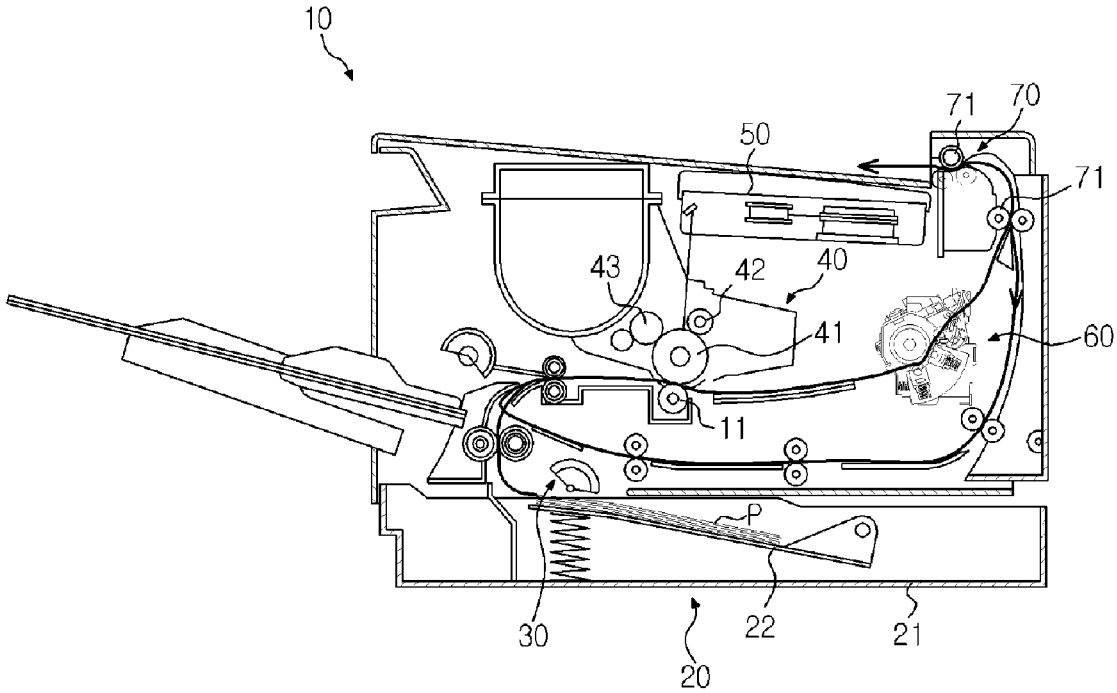
FIG. 1 is a sectional view illustrating a schematic configuration of an image forming apparatus according to an exemplary embodiment of the present general inventive concept.

Reference will now be made in detail to the exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

Hereinafter, an image forming apparatus according to an exemplary embodiment of the present general inventive concept will be described in detail with reference to the accompanying drawings.

As illustrated in FIG. 1, the image forming apparatus according to an exemplary embodiment may include a body 10 to define an external appearance of the apparatus, a printing media storage unit 20 in which paper P may be stored, the printing media storage unit 20 to detachably couple with the body 10, a pickup unit 30 to pick up the paper P stored in the printing media storage unit 20, a developing unit 40 to form a visible image via developer fed to the paper P having passed through the pickup unit 30, an exposure unit 50 to form an electrostatic latent image on a photoconductor 41 of the developing unit 40, a fusing unit 60 to fuse the developer transferred to the paper P, and a paper discharge unit 70 to discharge the paper P, on which the image is completely formed, to the outside of the body 10. The printing media storage unit 20 may supply the paper P to the developing unit 40.

The printing media storage unit 20 may include a printing media cassette 21 of a drawer type, which may detachably couple to the body 10 in a forwardly and rearwardly movable manner, and a knock-up plate 22 arranged in the printing media cassette 21, on which the paper P may be stacked.

The pickup unit 30 may pick up an uppermost sheet of the paper P stored in the printing media storage unit 20 sheet by sheet, to transmit the picked-up paper P to the developing unit 40.

The developing unit 40 may form a visible image via developer fed to the paper P supplied from the printing media storage unit 20. The developing unit 40 may include a photoconductor 41 on a surface of which an electrostatic latent image may be formed by the exposure unit 50, a charging roller 42 to charge the photoconductor 41 with an electric potential, and a developing roller 43 to develop the electrostatic latent image formed on the photoconductor 41 into a visible image. A transfer roller 11 may be provided in the body 10 at a position opposite the photoconductor 41. The transfer roller 11 may support the paper P toward the photoconductor 41, to transfer the visible image formed on the photoconductor 41 to the paper P.

The exposure unit 50 may irradiate light containing image information to the photoconductor 41 to form an electrostatic latent image on the photoconductor 41.

The paper discharge unit 70 may include paper discharge rollers 71 arranged in sequence and to discharge the paper P, having passed through the fusing unit 60, to the outside of the body 10.

Figure 2:
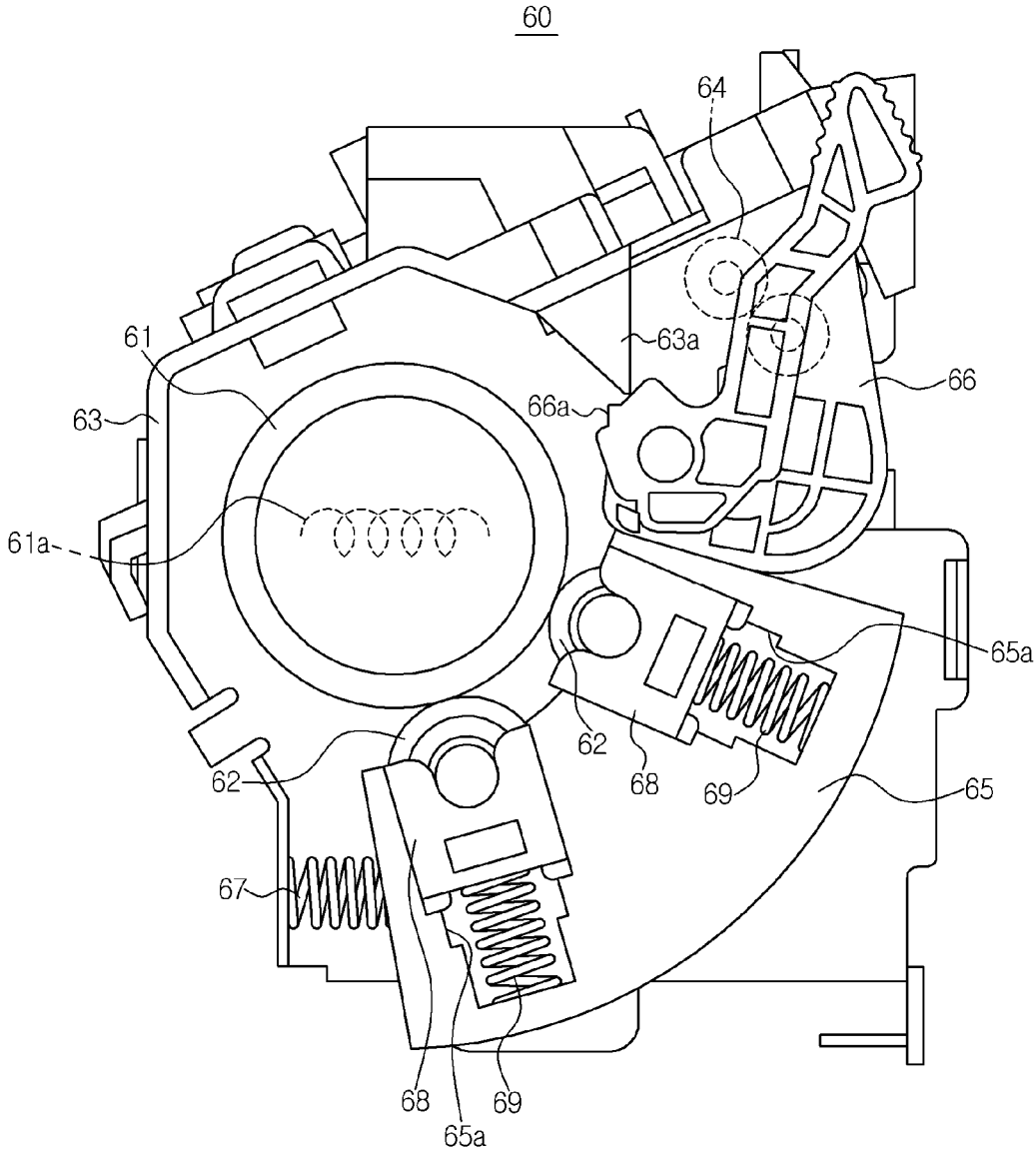
FIGS. 2 and 3 are side views illustrating operation of pressure rollers of a fusing unit according to an exemplary embodiment of the present general inventive concept.

The fusing unit 60 may fuse the image formed on the paper P to the paper P by applying heat and pressure to the paper P. The fusing unit 60 may include a heating roller 61 in which a heater 61*a* may be received, and a plurality of pressure rollers 62 elastically supported on an outer peripheral surface of the heating roller 61. In addition, as illustrated in FIG. 2, the fusing unit 60 may include a fusing frame 63 to define an external appearance of the fusing unit 60, to which the heating roller 61 and the plurality of pressure rollers 62 may be mounted, and a pair of paper discharge rollers 64 to rotate the fusing frame 63 and guide the paper P, which may pass between the heating roller 61 and the pressure rollers 62 thus completely subjecting paper P to a fusing operation, to the outside of the fusing unit 60. In the present exemplary embodiment, a pair of pressure rollers 62 may be provided.

In the image forming apparatus according to the present exemplary embodiment of the present general inventive concept, to deal with all curls of different kinds of paper P, the plurality of pressure rollers 62 may be rotatably arranged in a circumferential direction of the heating roller 61 about the heating roller 61. For this, the fusing frame 63 may provide a pivoting frame 65, a pivoting lever 66, and a return spring 67. The pivoting frame 65 may pivotally rotatably arranged in a circumferential direction of the heating roller 61 about the heating roller 61. The plurality of pressure rollers 62 may be mounted to the pivoting frame 65. The pivoting lever 66 may rotate the pivoting frame 65 upon receiving an external force. The return spring 67 may have one end supported by the fusing frame 63 and the other end supported by the pivoting frame 65 and thus, may return the pivoting frame 65 rotated by the pivoting lever 66 to an original position thereof. The fusing frame 63 may provide a first holder 63*a* to be caught by the pivoting lever 66, and the pivoting lever 66 may provide a second holder 66*a* to be caught by the first holder 63*a*. The pivoting lever 66 may be supported by the fusing frame 63 via the first holder 63*a* and second holder 66*a*, so that the pivoting lever 66 and pivoting frame 65 may be kept in a rotated state by a predetermined angle θ.

The pressure rollers 62 may be mounted to the pivoting frame 65 such that the pressure rollers 62 may move forwardly and rearwardly in a radial direction of the heating roller 61 so as to be elastically supported by the heating roller 61. For this, roller brackets 68, to which the pressure rollers 62 may be rotatably provided, may be mounted to the pivoting frame 65 in a forwardly and rearwardly movable manner. The pivoting frame 65 may have guide recesses 65*a* indented in the radial direction of the heating roller 61 such that the roller brackets 68 may be fitted into the guide recesses 65*a* in a forwardly and rearwardly movable manner. A press spring 69 may be received in each of the guide recesses 65*a*. One end of the press spring 69 may be supported by the pivoting frame 65 and the other end may be supported by the roller bracket 68, thus allowing the pressure roller 62 to be elastically supported by the pivoting frame 65.

Figure 3:
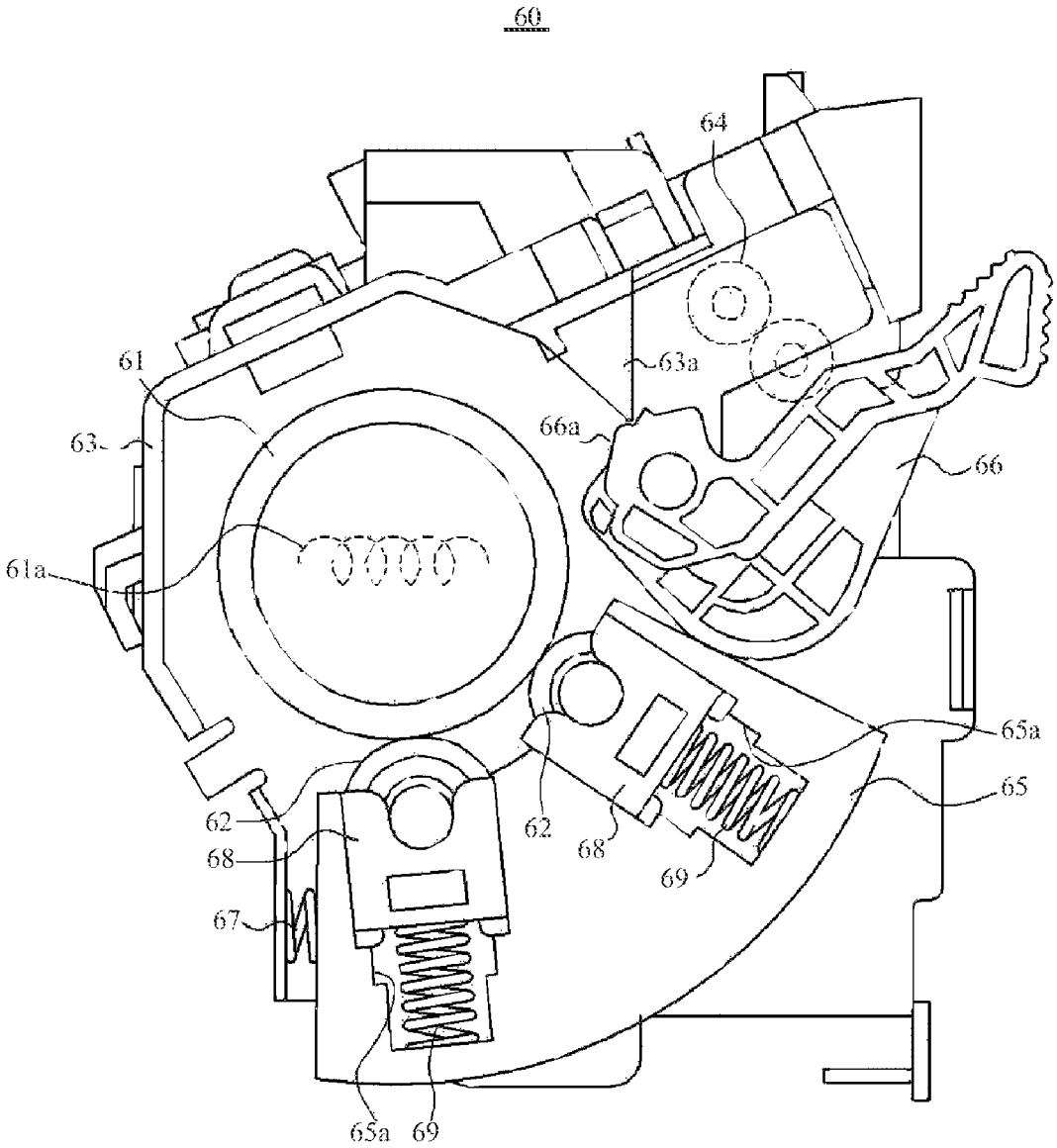
Figure 4:
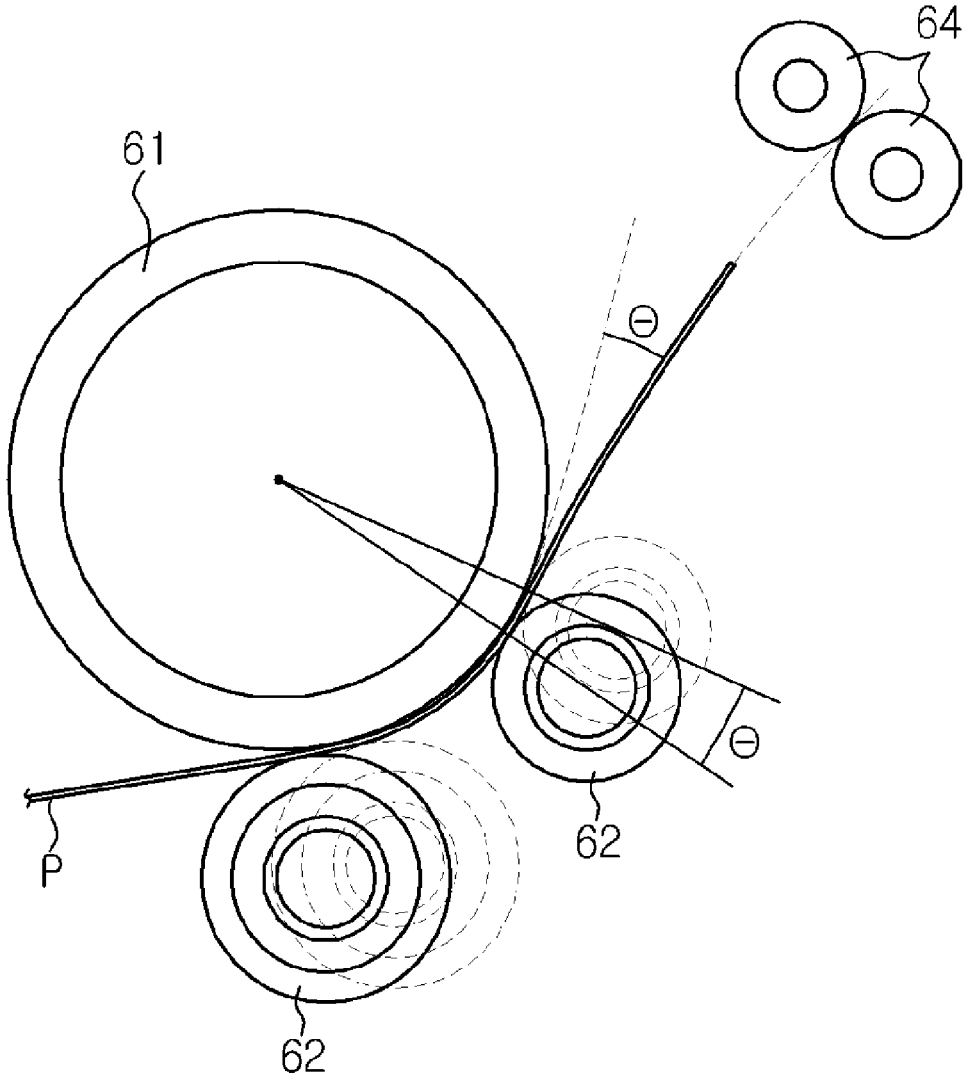
FIG. 4 is a schematic view illustrating a paper movement path based on operation of the pressure rollers of the fusing unit according to an exemplary embodiment of the present general inventive concept.

With the above-described configuration, if paper jam occurs frequently due to the use of paper P that undergoes serious curling, as illustrated in FIG. 3, the pivoting frame 65 may be rotated by the pivoting lever 66 until the first holder 63*a* is caught by the second holder 66*a*. Thereby, as illustrated in FIG. 4, the pressure rollers 62 may move in the circumferential direction of the heating roller 61 by a predetermined angle θ, thus causing the paper P, having passed between the heating roller 61 and the pressure rollers 62, to be moved in a path rotated by an angle θ corresponding to a rotation angle θ of the pivoting frame 65. As a result, even if serious curling of the paper P occurs, the paper P may enter between the paper discharge rollers 64 of the fusing unit 60. On the other hand, if paper P that undergoes slight curling is used, then the pivoting lever 66 may return to an original position thereof to return the pivoting frame 65 to an original position thereof via an elastic restoration force of the return spring 67, thus allowing the paper P that undergoes slight curling to enter between the paper discharge rollers 64. Accordingly, changing positions of the pressure rollers 62 via the pivoting lever 66 may enable the use of both the paper P that undergoes serious curling and the paper P that undergoes slight curling.

Figure 5:
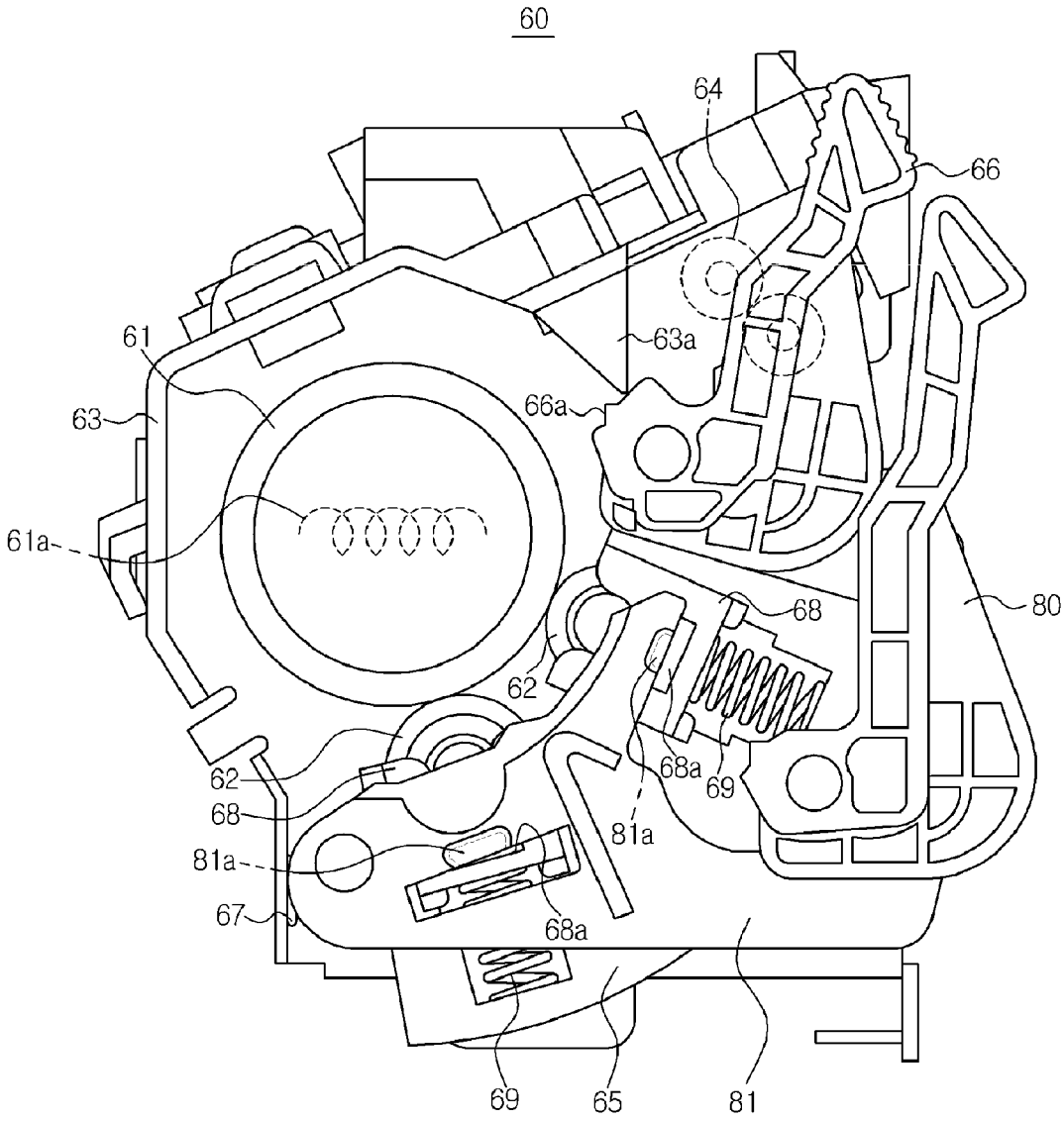
FIG. 5 is a side view illustrating pressure-release levers of the fusing unit according to an exemplary embodiment of the present general inventive concept.

As illustrated in FIG. 5, the fusing frame 63 may be provided with pressure-release levers 80 and 81. The pressure-release levers 80 and 81 may release pressure usable with the heating roller 61 by the pressure rollers 62, to settle paper jam in the fusing unit 60. The pressure-release levers 80 and 81 may include a first pressure-release lever 80 and a second pressure-release lever 81. The first pressure-release lever 80 may have one end rotatably coupled to the pivoting frame 65, to receive an external force. The second pressure-release lever 81 may have one end rotatably coupled to the pivoting frame 65 and the other end supported by the first pressure-release lever 80. Thus, the second pressure-release lever 81 may rotate upon receiving the external force transmitted via the first pressure-release lever 80 and may move the pressure rollers 62. As the second pressure-release lever 81 is rotated by the first pressure-release lever 80, the second pressure-release lever 81 may move the pressure rollers 62 outward in the radial direction of the heating roller 61, thus enabling release of the pressure usable with the heating roller 61 by the pressure rollers 62. To transmit the external force usable with the second pressure-release lever 81 to the pressure rollers 62, the second pressure-release lever 81 may be provided with holding protrusions 81*a* to be caught by the roller brackets 68, and the roller brackets 68 may be formed with holding recesses 68*a* to insert the protrusions 81*a*.

Accordingly, if a user applies an external force to the first pressure-release lever 80 to rotate the second pressure-release lever 81, the force may transmit to the roller brackets 68 via the holding protrusions 81*a* and holding recesses 68*a* to cause the roller brackets 68 to move outward in the radial direction of the heating roller 61 in the guide recesses 65*a* while elastically deforming the press springs 69. Thereby, the pressure usable with the heating roller 61 by the pressure rollers 62 may be released and thus, easily settling a paper jam between the heating roller 61 and the pressure rollers 62. If the first pressure-release lever 80 is returned to an original position thereof to remove the external force usable with the second pressure-release lever 81 after settling the paper jam, the pressure rollers 62 and the second pressure-release lever 81 may return to original positions thereof via elastic restoration force of the press springs 69.

As is apparent from the above description and in the case where paper that undergoes serious curling beyond an appropriate level is used, a fusing unit of an exemplary embodiment of the present general inventive concept may provide pressure rollers of the fusing unit to rotate and allow paper, having passed between a heating roller and the pressure rollers, to be moved in a path rotated by an angle corresponding to a rotation angle of the pressure rollers. This embodiment may reduce paper jam Although an exemplary embodiment of the present general inventive concept has been illustrated and described, it would be appreciated by those skilled in the art that changes may be made in the exemplary embodiment without departing from the principles and spirit of the general inventive concept, the scope of which is defined in the claims and their equivalents.

What is claimed is:

1. A fusing unit comprising:

a heating roller;

a fusing frame to receive the heating roller;

a pivoting frame mounted to the fusing frame and configured to rotate around the heating roller; and pressure rollers to mount to the pivoting frame and configured to be elastically supported on an outer peripheral surface of the heating roller.

2. The unit according to claim 1, further comprising:

a pivoting lever to mount to the fusing frame and configured to rotate the pivoting frame.

3. The unit according to claim 1, further comprising:

a return spring extending between the fusing frame and the pivoting frame and configured to bias the pivoting frame toward an original position thereof.

4. The unit according to claim 2, wherein:

the fusing frame comprises first holder; and the pivoting lever comprises a second holder to contact the first holder such that the pivot frame is held in a rotated position.

5. The unit according to claim 1, further comprising:

roller brackets disposed on the pivoting frame and configured to move the pressure rollers with respect to the heating roller; and press springs extending from the pivoting frame to the roller brackets.

6. The unit according to claim 5, wherein the pivoting frame comprises guide recesses to guide the movement of the roller brackets.

7. The unit according to claim 1, further comprising:

a pressure-release lever disposed on the pivoting frame and configured to reduce pressure between pressure rollers and the heating roller.

8. The unit according to claim 7, wherein:

the pressure-release lever comprises holding protrusions to contact the roller brackets; and the roller brackets comprise holding recesses to receive the holding protrusions.

9. The unit according to claim 1, further comprising:

paper discharge rollers to guide the discharge of paper from the fusing unit.

10. A fusing unit comprising:

a heating roller;

pressure rollers elastically supported on an outer peripheral surface of the heating roller; and a pivoting frame to receive the pressure rollers and configured to rotate around the heating roller.

11. The unit according to claim 10, further comprising:

a pivoting lever to rotate the pivoting frame; and a return spring to bias the pivoting frame toward an original position thereof.

12. The unit according to claim 11, further comprising:

roller brackets disposed on the pivoting frame to receive the pressure rollers and configured to move with respect to the heating roller;

press springs extending between the pivoting frame and the roller brackets; and a pressure-release lever to move the roller brackets to reduce pressure between the pressure rollers and the heating roller.

13. An image forming apparatus comprising:

a fusing frame;

a heating roller disposed on the fusing frame;

a pivoting frame mounted to the fusing frame and configured to rotate around the heating roller; and pressure rollers to mount to the pivoting frame and configured to be elastically supported on an outer peripheral surface of the heating roller.

14. The apparatus according to claim 13, further comprising:

a pivoting lever to mount to the fusing frame and configured to rotate the pivoting frame; and a return spring extending between the fusing frame and the pivoting frame and configured to bias the pivoting frame toward an original position thereof.

15. The apparatus according to claim 13, further comprising:

a roller brackets disposed on the pivoting frame and configured to move the pressure rollers with respect to the heating roller; and press springs extending between the pivoting frame and the roller brackets.

16. The apparatus according to claim 13, further comprising:

a pressure-release lever to reduce the pressure between the pressure rollers and the heating roller.

* * * * *